United States Patent [19]

Jones

[11] 4,455,713

[45] * Jun. 26, 1984

[54] METHOD AND APPARATUS FOR REMOVING TRASH FROM MATERIAL

[75] Inventor: Joseph K. Jones, Raleigh, N.C.

[73] Assignee: Cotton Incorporated, New York, N.Y.

[ * ] Notice: The portion of the term of this patent subsequent to Jul. 13, 1999 has been disclaimed.

[21] Appl. No.: 375,178

[22] Filed: May 5, 1982

Related U.S. Application Data

[63] Continuation-in-part of Ser. No. 118,977, Feb. 6, 1980, Pat. No. 4,338,705.

[51] Int. Cl.[3] ..... D01G 9/00

[52] U.S. Cl. ..... 19/80 R

[58] Field of Search ..... 19/80 R, 81, 200

[56] References Cited

U.S. PATENT DOCUMENTS

| | | | |
|---|---|---|---|
| 1,449,392 | 3/1923 | Freeman | 19/80 R |
| 1,514,044 | 11/1924 | Harlan | 19/80 R |
| 1,533,593 | 4/1925 | Harlan | 19/80 R |
| 2,009,140 | 7/1935 | Knowlton | 19/80 R |
| 4,135,276 | 1/1979 | Handschuch et al. | 19/200 X |
| 4,300,267 | 11/1981 | Winch et al. | 19/200 |
| 4,338,705 | 7/1982 | Jones | 19/80 R |

*Primary Examiner*—Doris L. Troutman

*Attorney, Agent, or Firm*—Burns, Doane, Swecker & Mathis

[57] ABSTRACT

The present invention relates to a method and apparatus for separating trash from irregularly-shaped clusters of material containing trash, fiber motes, and cotton lint. The apparatus comprises a rotatable drum encircled by a screen on an inside periphery thereof. The drum contains a plurality of finger-shaped baffles arranged in rows and extending radially inwardly from the inside periphery of the drum. As material is delivered to the rotating drum, the finger-shaped baffles lift the material toward an upper portion of the drum and drop the material directly on the screen at a lower portion of the drum to break-up clusters of material and to separate the heavy trash. The heavy trash drops through the screen and is removed by a conveyor. The fiber motes and cotton lint, along with smaller trash, are retained within the rotating drum and removed at an outlet end of the drum. The present invention also provides a clearing arrangement preferably in the form of an elongated brush contacting an outside surface of the screen. The brush operates to remove fibers and/or other material from openings in the screen.

18 Claims, 3 Drawing Figures

METHOD AND APPARATUS FOR REMOVING TRASH FROM MATERIAL

RELATED APPLICATION

This application is a continuation-in-part of United States Application Ser. No. 118,977, filed Feb. 6, 1980, now U.S. Pat. No. 4,338,705, issued 7/13/82.

BACKGROUND AND SUMMARY OF THE PRESENT INVENTION

The present invention relates to an improved method and apparatus for removing trash from material. More particularly, the present invention relates to a method and apparatus for removing heavy trash from formerly waste material containing trash, cotton lint, and motes.

During cotton ginning and early textile mill processing, a substantial quantity of good fiber is usually discarded with the trash. Much of this cotton fiber is contained in cotton motes. Cotton motes are those cotton fiber aggregates which are sufficiently dense to be discarded with the trash in conventional cleaning processes. The trash includes such particles as stems, burrs, leaf particles, etc. In order to more effectively utilize the fiber contained within the waste material, it is necessary to remove a substantial quantity of the heavy trash before attempting any further processing of the material.

A device for drying and cleaning cotton is disclosed in U.S. Pat. No. 1,449,392, issued Mar. 27, 1923 to Freeman. The Freeman patent discloses a rotatable drum surrounded on an outside periphery by a screen. Longitudinal reinforcing ribs are disposed along the inner periphery of the screen from one end to the other of the drum. The ribs are held against the inner surface of the screen by brace rings which are arranged further inside the drum. In addition, a plurality of equally spaced longitudinal truss rods extend along the inside surface of the drum. A plurality of fingers are threaded through the mesh of the screen and looped around the ribs with one end of the finger extending inwardly and being angled in the direction of the rotation of the drum.

It is submitted that an apparatus of the type disclosed in the Freeman patent produces a continuous rolling action rather than a cyclical lifting and dropping. This rolling action is due in part to the number of fingers contained within the drum of the Freeman patent. In other words, each longitudinal row of fingers picks up a small portion of the cotton and lifts the cotton toward the upper portion of the drum. This cotton is subsequently dropped toward the lower portion of the drum which is likely to be covered with cotton dropped by the immediately preceding longitudinal row of fingers.

In addition, a device of this type includes reinforcing ribs inside the screen such that the cotton cannot be dropped directly onto the screen to produce a vibratory action which aids in breaking up clusters of material. In other words, the cotton is likely to be dropped upon the ribs and then falls gently onto the screen rather than impacting directly on the screen. Still further, masses of cotton may become stagnant or stuck between each of the ribs and may not be affected by the rotation of the drum and lifted by the fingers. Further, due to the angled orientation of the fingers in the direction of rotation in the Freeman patent, cotton may be dropped along the back side of the fingers preventing a pulling action from being imparted by the fingers.

It is an object of the present invention to provide a method and apparatus which will effectively separate the heavy trash from waste material discarded by cotton gin and early textile mill processing.

It is a further object of the present invention to provide an apparatus which removes heavy trash and is simple in operation and construction and can be easily installed in existing cotton processing plants.

Still a further object of the present invention is to provide an apparatus for removing trash that can be operated for long periods of time without requiring stopping for cleaning or other maintenance.

These and other objects of the present invention are satisfied by providing an elongated drum with a plurality of finger-shaped baffles arranged on an inner periphery of the drum. An interior of the drum is surrounded by a screen having a small opening size to permit the heavy trash to fall through while retaining the motes and some lighter trash. The baffles are the only structual elements extending inwardly of the screen. In other words, any stiffening arrangement provided for maintaining the screen relatively rigid are arranged at a distance from a longitudinal axis of the drum which distance is at least equal to the distance of the screen from the axis. The drum is slowly rotated in order to lift the material to an upper portion of the drum with the finger-shaped baffles and drop the material onto the screen at a lower portion of the drum. This lifting and dropping action combined with the rotation of the drum acts similar to a vibratory action and tends to separate the trash from the material.

According to a further aspect of the present invention, an arrangement for continuously clearing material from openings in the screen is provided. In a preferred embodiment, the arrangement includes a brush which is arranged at a location on an outside surface of the drum which location is beyond the location where the baffles drop the material in the direction of rotation of the drum. The brush is arranged such that an outer peripheral surface of the brush contacts an outer surface of the screen. In a preferred embodiment, the brush is rotated about a longitudinal axis which is parallel with the longitudinal axis of the drum. The peripheral speed of rotation of the brush is preferably greater than the outer peripheral speed of the drum, particularly when the brush is rotated in the same direction of rotation as the drum.

Still further according to the present invention, the baffles are arranged in two to four rows with the baffles of each row extending along radii of the drum and being parallel to one another. Preferably, the rows are arranged symmetrically about the inside periphery of the drum. According to a still further aspect of the present invention, a plurality of rod-like elements for breaking up large clumps or portions of the material are provided on an inside surface of the drum. The rod-like elements are substantially shorter than the finger-shaped baffles such that the rod-like elements function to break up clumps or large portions of material rather than producing a substantial lifting and dropping action as do the finger-shaped baffles. The rod-like elements are preferably arranged in rows circumferentially spaced from the rows of the baffles with each rod-like element being arranged between adjacent ones of the finger-shaped baffles along the longitudinal axis of the drum.

It is further preferred that two rotating drums be provided to increase the efficiency of the apparatus. Also, the trash which drops through the screen is picked up by a conveyor and delivered to a trash disposal system. The present invention may be useful in a method and apparatus of the type disclosed in U.S. Pat. No. 4,300,267 issued Nov. 17, 1981 to Winch et al. for "Total Fiber Recovery Method and Apparatus".

BRIEF DESCRIPTION OF THE DRAWINGS

A preferred embodiment of the present invention will be described in greater detail with reference to the accompanying drawings wherein like members bear like reference numerals and wherein.

DETAILED DESCRIPTION OF THE PREFERRED EMBODIMENT

Figure 1:
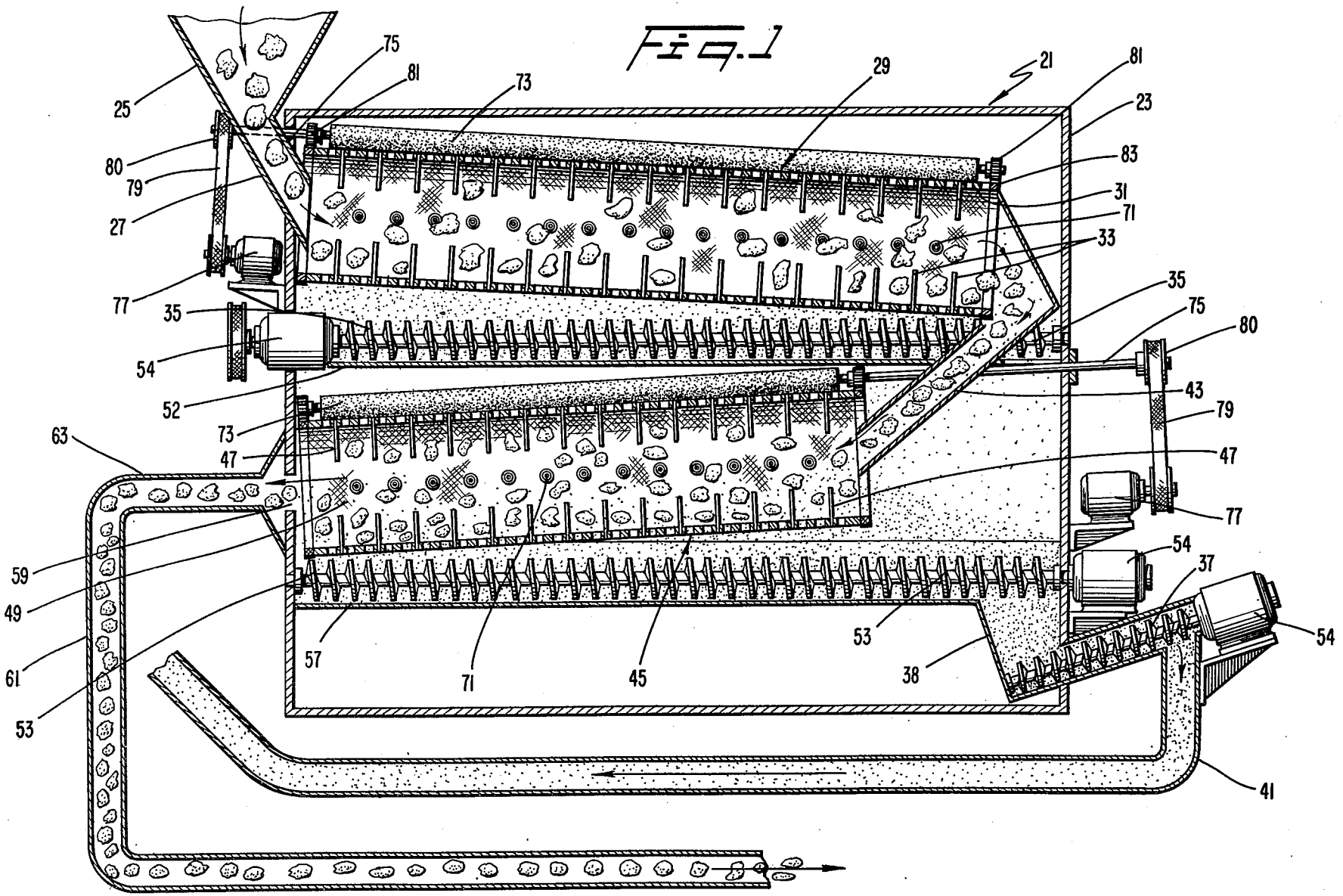
FIG. 1 is a schematic cross-sectional view of an apparatus according to the present invention.

With reference to FIG. 1, an apparatus according to the present invention, called for convenience a drum screen cleaner, is generally indicated by reference numeral 21. The drum screen cleaner 21 includes a housing 23. Waste material containing trash, motes, and cotton lint from an early textile or ginning process is first fed into a long body cyclone 25 of a suitable design in which air is removed from the waste material and the waste material is formed into irregularly shaped clumps or clusters. The clusters of waste material leaving the cyclone 25 are fed through a line 27 which passes through the housing 23 into a first elongated rotary drum 29 of the cleaner. The drum 29 includes a screen 21 around the periphery thereof. Under slight negative pressure, the drum 29 is rotated so that the clusters of material are tumbled to shake out the heavier trash particles as explained in more detail below. The negative pressure is obtained by withdrawing air through a vent (not shown) in the cleaner housing 23. The slight negative pressure also operates to aid in the removal of dust and lint fly generated in the drum screen cleaner.

Figure 2:
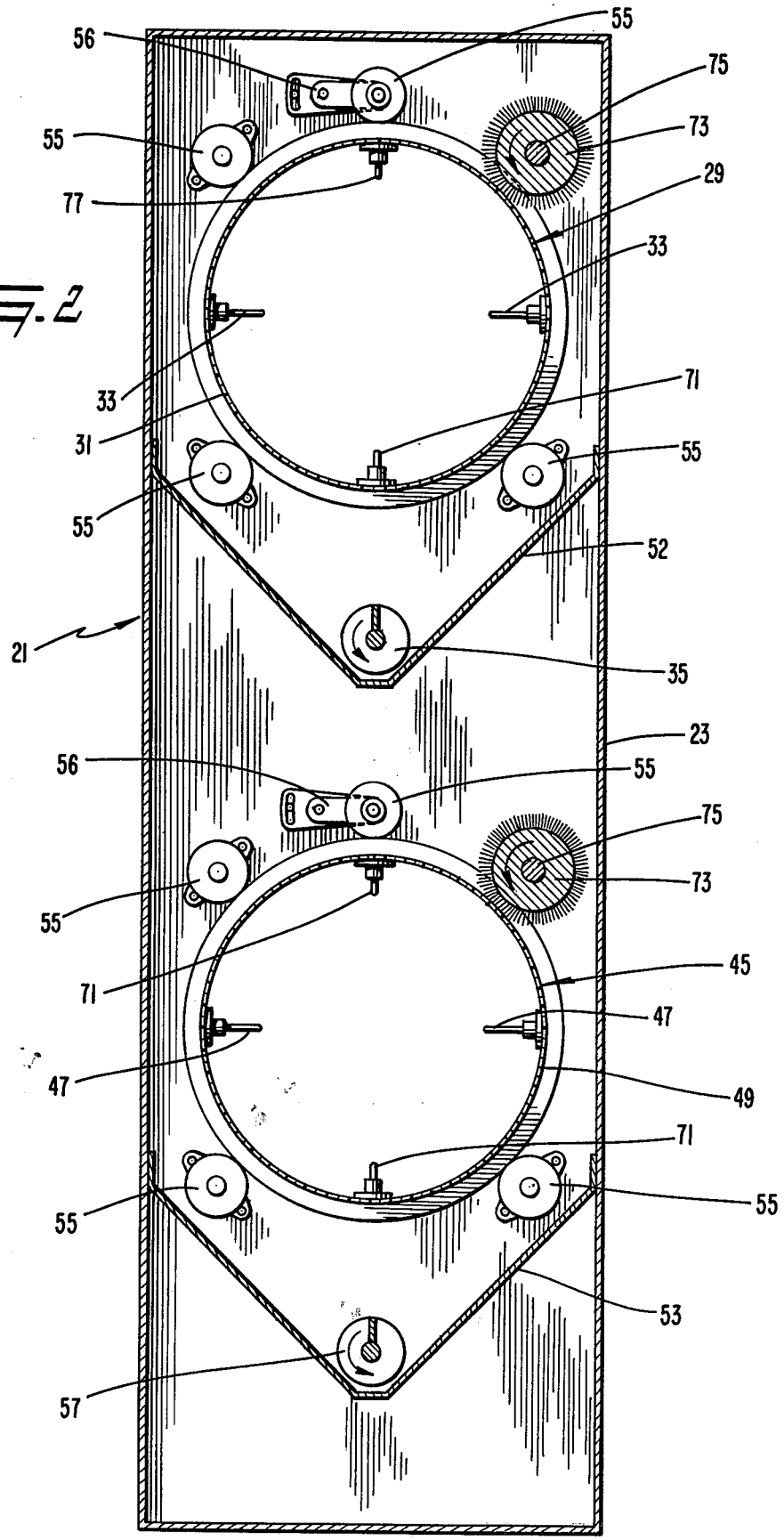
FIG. 2 is a view taken substantially along the line 2—2 in FIG. 1.

With reference to FIG. 2, the screen 31 is arranged such that the screen forms the furthest continuous inside periphery of the drum. In other words, there are no supporting structural features for the drum 29, e.g., central shaft, reinforcing ribs, stiffening rings or the like, within the interior of the drum 29. The inside surface of the screen 31 is substantially totally exposed to the interior of the drum. In this way, when material is deposited within the drum 29 and the drum is rotated, the material impacts directly upon the surface of the screen 31.

In a preferred embodiment, the screen 31 comprises a piece of sheet metal which is provided with a plurality of holes 32 of a predetermined size therein. Due to the strength of the sheet metal remaining in the screen 31 after providing the plurality of holes 32, the sheet metal is self-supporting, i.e., the screen 31 itself functions as a stiffening arrangement for the drum. In this way, additional stiffening structure within the interior of the drum is easily avoided. Alternatively, if the screen 31 is comprised of a more flexible material, e.g., a wire mesh screen, longitudinal stiffening ribs (not shown) may be required. However, in order to fully realize the advantages of the arrangement according to the present invention, such stiffening ribs should be arranged on an outside surface of the screen such that interference with the direct contact between the material and the inside peripheral surface of the screen 31 is avoided. In other words, any stiffening arrangement for maintaining the screen relatively rigid is arranged at a distance from a longitudinal axis of the drum 29 at least equal to the distance of the inside peripheral surface of the screen 31 from the longitudinal axis of the drum 29.

On the inner circumferential surface of the first drum 29, a plurality of finger-shaped baffles 33, i.e., elongated thin rods, are provided. In the illustrated embodiment, the baffles 33 are arranged in two rows disposed 180° apart. Within each row, the baffles are arranged parallel to one another along radii of the first drum 29. It has been found that two rows of baffles are desirable for drums having diameters up to 24 inches. In a 30 inch drum, three rows of baffles 33 arranged symmetrically about the circumference of the drum 29 may provide the proper cleaning action. In larger drums, four symmetrical rows may be desirable. However, the number of rows of baffles 33 should not be so great that the action of one row interferes with the action of an adjacent row. For practical drum diameters, four rows appear to be the largest desired number of rows.

In a preferred embodiment, each of the baffles is made from ¼-inch round stock which is cut to a length of approximately 6 inches. The baffles are preferably spaced approximately 6 inches apart along the horizontal length of the drum. As illustrated in FIG. 1, the baffles of one row are disposed along substantially the same diameter as corresponding baffles of the other row. Alternatively, the baffles of one row could be arranged along diameters lying to either side of the baffles of the other row in an axial direction.

The baffles 33 lift the clusters of material toward an upper portion of the drum 29 during rotation of the drum 29 about the axis of the drum and drop or impact the clusters of material directly onto the screen 31 at a lower portion of the drum 29, similar to a vibratory action. The finger-shaped baffles 33 are spaced sufficiently far apart to allow the clusters of material to pass therebetween so that the clusters will continue to be lifted and dropped by the other row of baffles 33 to aid in pulling the clusters of material apart for greater opening and better heavy trash removal. The amount of lift imparted to the clusters of material by the baffles 33 depends upon the size and shape of the incoming material and also upon how well the material is picked up and/or balanced upon individual baffles. The pulling action caused by the baffles 33 tends to break up the material and free a large percentage of the trash. The continuous action of the baffles 33, as the drum 29 rotates and the material moves by gravity through the first drum 29, breaks up the clusters of material to expose more trash and allow the trash to drop out through the openings 32 in the screen 31. It is the cyclical action of lifting and dropping the material directly onto the screen 31 which produces the desired result.

A substantial portion of the material is lifted toward an upper portion of the drum by one row of the finger-shaped baffles 33 and is dropped directly onto the screen 31 without contacting any reinforcing ribs since the screen 31 is arranged on the furthest inside periphery of the drum. Further, since a substantial portion of the material is lifted by the baffles 33 as it passes the lower portion of the drum 29, the material which is dropped from the upper portion of the drum drops onto a substantially clean screen 31. In other words, the screen 31 is clear of large masses of material. By impacting the material directly upon the screen 31, more of the trash material is "forced" through the screen rather than being "sifted" through a mass of material on the lower portion of the drum 29. Accordingly, the number of rows of baffles 33 must be limited to avoid a rolling action rather than a lifting and dropping action. It is the cyclical lifting, dropping and pulling action imparted by the finger-shaped baffles which produces the desired cleaning effect. The direct impact of the material upon the screen 31 further enhances the operation of the present invention.

The heavy trash which drops through the screen 31 of the first drum 29 is collected by a first screw conveyor 35 disposed underneath the first drum 29. The trash collected on the first conveyor 35 moves from left to right as seen in FIG. 1 and is discharged downwardly by gravity and eventually picked up by a conveyor 37 driven by any suitable device 39 and delivered through a line 41 to any suitable trash disposal system. The conveyor 37 is arranged in an angled container 38 which aids in directing the trash towards the conveyor 37.

The material retained by the first drum 29 moves through a line 43 to a second drum 45 containing a second plurality of baffles 47 similar to the baffles 33 in the first drum 29. Once again, a lifting and dropping action occurs as the second drum 45 rotates to separate more trash from the material. The heavy trash which drops through a screen 49 encircling the inside periphery of the second drum 45 is collected on a second screw conveyor 51. The trash is transported by the screw conveyor 51 to the conveyor 37 which removes the trash to the trash disposal system (not shown). The screw conveyors 35, 51 are driven by any suitable drive mechanism 54. Angled metal sheets 52, 53 are disposed beneath the first and the second screw conveyors 35, 51 respectively in order to ensure that the trash is transported to the right as seen in FIG. 1 and dropped onto the conveyor 37.

According to a further aspect of the present invention, each of the drums is provided with a plurality of rod-like elements 71 for breaking up large portions or clumps of the material. The rod-like elements 71 will be described with reference to the first drum 29. However, it will be understood that the description applies equally to the second drum 45. In a preferred embodiment, with two row of baffles 33, the rod-like elements 71 are arranged in two rows substantially 180° apart with each of the rod-like elements extending along a radius of the drum. Each row of rod-like element 71 is arranged substantially 90° from a row of the finger-shaped baffles 33. The rod-like elements 71 perform a function which is different from that performed by the finger-shaped baffles 33. In particular, the rod-like elements 71 are adapted to separate large clumps of material passing thereby. Spacing must be maintained between the rod-like elements 71 in order to perform the intended function. In other words, a continuous longitudinal rib would not function in the manner desired. It is important to note that the rod-like elements 71 are substantially shorter than the finger-shaped baffles 33. The substantially shorter radial length of the elements 71 tends to prevent a substantial amount of lifting and dropping action as developed by the longer finger-shaped baffles 33.

In a preferred embodiment, when using approximately 6 inch baffles 33, the rod-like elements 71 should be approximately 3 inches in length. In order to further aid the breaking up action of the rod-like elements 71, the rod-like elements 71 are arranged along the longitudinal length of the drum such that each rod-like element 71 is arranged between two adjacent baffles 33 when viewed in the longitudinal direction. In this way, large clumps which may have passed between adjacent baffles 33 are engaged by the rod-like elements 71 to break up the clumps before being lifted by the following row of baffles 33. It should be noted that the use of the rod-like elements 71 is dependent upon the diameter of the drum. For example, in a 24 inch diameter drum, two rows of finger-shaped baffles 33 provides sufficient cleaning action without the use of any rod-like elements. In a 30 inch diameter drum, the use of the rod-like elements 71 further improves the cleaning action therein. As noted previously, it may be desirable to eliminate the rod-like elements 71 and to arrange three rows of finger-shaped baffles symmetrically about the inside of the drum in a 30 inch drum.

According to still a further aspect of the present invention, an arrangement for clearing material from the openings 32 of the screen 31 is also provided. The clearing arrangement will be described with reference to the first drum 29 but is preferably provided on the second drum 45 as well. It is been found that after a period of use of the drum screen cleaner according to the present invention, "fuzzy" fibers may become caught within the openings 32 of the screen 31. In order to provide proper trash removal action by the cleaner apparatus according to the present invention, it is desirable to maintain the openings 32 of the screen 31 substantially open at all times. According to the present invention, a clearing arrangement in the form of an elongated brush 73 is provided. The brush 73 is preferably arranged such that a longitudinal axis 75 of the brush 73 is substantially parallel to the longitudinal axis of the drum 29. Further, the brush 73 is arranged such that an outer peripheral surface of the brush 73 contacts an outer peripheral surface of the screen 31. The clearing operation of the brush 73 may be enhanced by employing a self-supporting screen 31. In this way, no structure is present on the outside of the screen 31 which structure may interfere with the operation of the brush 73.

The brush 73 is preferably driven about its longitudinal axis 75 by any suitable apparatus. The direction of rotation of the brush may be in the direction opposite to that of the drum (as shown in the illustrated embodiment) provided that the outer peripheral speed of the brush 73 is greater than the outer peripheral speed of the screen 31. In this way, proper cleaning or clearing action of the openings 32 is obtained. Alternatively, the brush could be rotated in the same direction of rotation as the drum thereby causing the outer peripheral surfaces to pass at the point of contact in opposite directions.

In a preferred embodiment, the longitudinal axis 75 of the brush 73 is arranged at a location on an outside of the drum 29 which location is beyond the location where the baffles 33 drop the material from the upper portion of the drum 29 in the direction of the rotation of the drum 29. In other words, since the material is dropped during rotation of the drum 29 as the row of baffles 33 approaches approximately the 12 o'clock position, the brush 75 is preferably arranged at approximately a location corresponding to the 2 o'clock position in the direction of rotation of the drum 29. With the arrangement of the brush 73 downstream from the dropping location, longer fibers which are desired to be contained within the drum 29 have previously dropped toward the bottom portion of the drum 29.

It has been found that primarily only "fuzzy" fibers, i.e., very short fibers, rather than long fibers tend to be retained within the openings 32 of the screen 31. The bristles on the brush 73 tend to force at least a portion of these fuzzy fibers back toward the interior of the drum for further action by the baffles 33 and/or the rod-like elements 71. Some fuzzy fibers may be retained within the bristles of the brush. However, these very short fibers are not of substantial commercial importance. It should also be noted that by maintaining the screen openings 32 substantially clear, build up of fiber therein is avoided. In this way, when material is dropped from the upper portion of the drum 29, the material impacts directly upon a substantially clear screen 31 rather than upon a mass of tangled fibers within the openings 32 thereby further enhancing the vibratory, impacting cleaning action of the present invention.

Figure 3:
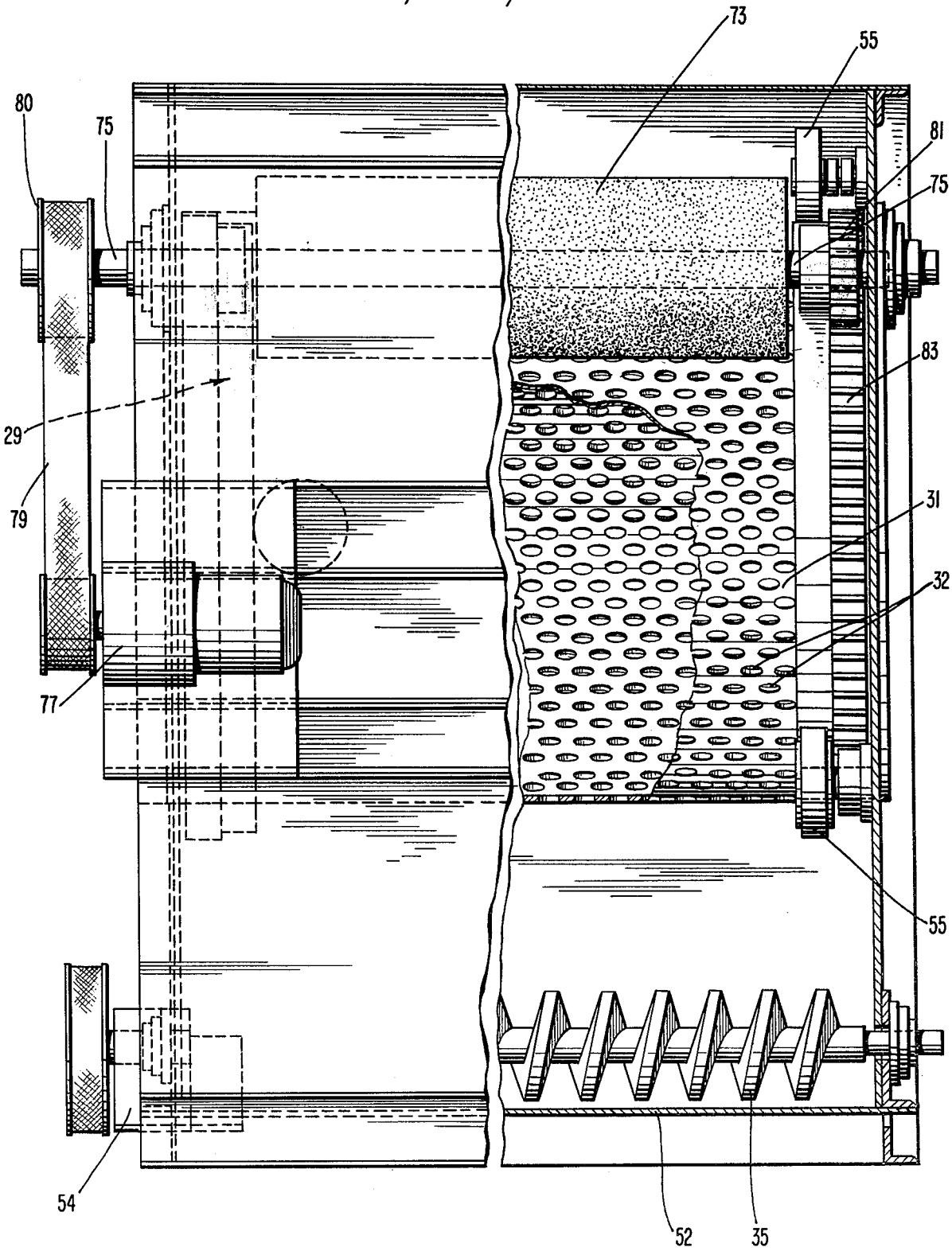
FIG. 3 is an enlarged view of a portion of the apparatus of FIG. 1.

With reference to FIG. 3, a preferred embodiment of the driving arrangement according to the present invention includes a motor 77 having an output shaft connected by a belt 79 to a pulley 80 on a shaft defining the longitudinal axis 75 of the brush 73. Accordingly, rotation of the motor 77 causes rotation of the brush 73 about the longitudinal axis 75. Arranged near ends of the shaft 75 are gears 81 which are adapted to mesh with peripheral gears 83 arranged on ends of the drum 29. In this way, the single motor 77 is operable to drive both the brush 73 and the drum 29. It should be noted that the diameter of the gear 81 is substantially smaller than the overall diameter of the brush 73. In this way, the outer peripheral speed of the brush 73 is substantially higher than the outer peripheral speed of the screen 31 of the drum 29 thereby ensuring proper clearing action of the brush 73 against the openings 32 of the screen 31.

Each of the first and the second drums 29, 45 is supported by a plurality of rollers 55 (FIG. 2). At least one of the rollers on each drum may be mounted on a cam arm 56*a* which is spring loaded (not shown) to maintain the drums in proper alignment for meshing engagement of the gears 81, 83 and for contacting the rollers 55. The rollers may be composed of a suitable rubber-like material or rubber belting may be provided on the portion of the drums in contact with the rollers to provide greater friction and to reduce noise. Other suitable driving or supporting arrangements may be provided if desired.

In a preferred embodiment, it has been found preferable for the openings in the screens 31, 49 surrounding the drums 29, 45, respectively, to be approximately ¼ of an inch in diameter. The screen opening may be of any suitable shape, (e.g., square, round, oblong, elliptical, etc.). The size of approximately ¼ of an inch in diameter allows the heavy trash to drop through and be removed by the screw conveyors 35, 51 while the fiber motes are retained. If a larger opening size is employed the motes would tend to fall through the screen with the trash. If a smaller opening size were employed, sufficient heavy trash would not be removed. The motes and light trash retained by the first and the second drums 29, 45 of the drum screen cleaner are removed through an opening 59 in the housing 23 at the outlet end of the second drum 45.

The motes and lighter trash which do not drop through the screens are removed from the outlet 59 of the cleaner by air admitted through openings 63 in a line 61. This material, which is only partially cleaned, is preferably subjected to further fine opening and cleaning in order to provide usable cotton fiber from the motes. The outlet 59 may alternatively be disposed at the outlet of the first drum 29 if only one drum is desired.

The method and apparatus of the present invention removes the heavy trash particles so that the retained material can be more easily cleaned and opened without subjecting the subsequent fine opening and cleaning devices to the detrimental effects of a substantial quantity of trash particles. In other words, the drum screen cleaner of the present invention is essentially a coarse cleaner.

The first and the second drums 29, 45 are also preferably provided with a mechanism for adjusting the angle of tilt between the inlet and the outlet ends of the respective drums. For example, shafts 65 which carry the rollers 55 may extend through slots (not shown) in the housing 23. In this way, the outlet end of each drum may be adjusted relative to a horizontal plane by manually raising the drum. Alternatively, each drum may be arranged in an individual frame which is adjustable by any suitable apparatus.

The adjustment in the angle of the drums is desirable in order to control the amount of time during which the material remains within the drums. As the volume of material deposited in the cleaner 21 increases, the angle of the drums 29, 45 with the horizontal is decreased since the material itself develops a flow line within each of the drum which creates an increased slope towards the outlet end of the drum. In a preferred embodiment, each of the drums is adjustable from a horizontal position to a position where a vertical drop of approximately six (6) inches occurs from the inlet to the outlet end of each drum.

Also, in the illustrated embodiment, the first drum 29 is approximately 10 feet long and 30 inches in diameter, while the second drum 45 is approximately 8 feet long and 30 inches in diameter. For these drum sizes, 6-inch diameter screw conveyors have been found to be appropriate. Also in a preferred embodiment, the two drums are rotated at a speed between 24–30 r.p.m.

It may be preferable to arrange the shorter drum above the longer drum. Among other advantages, this arrangement would permit the line 43 to be arranged centrally from the outlet of the first drum 29 to the inlet of the second drum 45 instead of towards the right or the left of the first screw conveyor 35 as in the illustrated embodiment. The relative length of the drums is not critical to the operation of the present invention and the drums could be constructed to be substantially the same length if desired.

In operation, the waste material is delivered to the long body cyclone 25. Air is separated from the waste material and the material is formed into irregular shaped clusters. The clusters of material are then moved by gravity and dropped into the first drum 29 where, due to the rotation of the drum, the clusters of the material are lifted by a row of the plurality of baffles 33 toward the upper portion of the drum 29 and dropped to the lower portion of the drum 29 directly onto a substantially clear screen 31 to break up and pull apart the custers of material and separate the trash. The relatively heavy trash drops through the screen 31 while the lighter trash and fiber motes are retained within the drum 29. Simultaneously, the brush 73 rotates such that its outer peripheral surface contacts the outer surface of the screen 31 to clear material from the openings 32 therein. Also, clumps of material are further broken up between the rows of baffles by the rod-like elements 71. Having moved through the first drum 29 by gravity, the remaining material is conducted through the line 43 by gravity into the second drum 45.

Due to the rotation of the second drum 45, similar cleaning action occurs. The material is lifted with a row of the second plurality of finger-shaped baffles 47 and dropped directly on the screen 49 to further break up the clusters of material and separate the trash. The relatively heavy trash drops through the screen 49 and is transported away by the second screw conveyor 51. The brush 73 in contact with the second drum 45 cleans the openings in the screen 49.

The trash particles conveyed by the first screw conveyor 35 and the second screw conveyor 51 are dropped by gravity into the receiver 38 where the trash is picked up by the conveyor 37 and transported through line 41 to a trash disposal system. The material remaining at the outlet 59 of the second drum 45 is transported in the line 61 by air introduced through the holes 63 to a further processing station.

As can be seen, the present invention provides a coarse cleaning for cotton containing waste material which effectively removes a substantial quantity of heavy trash. This trash removal permits the remaining material to be subjected to fine opening and cleaning at subsequent stations to obtain usable cotton fiber. The plurality of finger-shaped baffles disposed on the inner periphery of each of the rotating drums effectively pull apart the clusters of material allowing the heavy trash to drop away from the cotton motes. It is the continuous lifting, dropping, and pulling action imparted by these finger-shaped baffles and the direct impacting of material on the clear screen which produces the desired cleaning effect.

It is preferred that prior to subjecting the waste material to the action of the drum screen cleaner 21 that longer fibers remaining in the waste from cotton gin or early textile mill processing be removed. In this way, the drum screen cleaner can be most effectively used to separate the trash from the usable short fibers and motes. There will be less likelihood of nepping or entanglement of the fibers about the baffles during tumbling if the longer fibers have been previously removed.

As pointed out above, the length of each baffle and the spacing between adjacent baffles is arranged such that the lifting and tumbling action can be imparted to a great majority of the clusters of material. By providing two rotating drums, the efficiency of the drum screen cleaner is enhanced.

The principles, preferred embodiment and mode of operation of the present invention have been described in the foregoing specification. However, the invention which is intended to be protected is not to be construed as limited to the particular embodiments disclosed. Numerous modifications, variations, substitutions, and equivalents exist without materially departing from the scope of this invention. The embodiments disclosed are to be regarded as illustrative rather than restrictive. Accordingly, it is expressly intended that all such modifications, variations, substitutions, and equivalents which fall within the spirit and scope of the invention as defined in the claims be embraced thereby.

What is claimed is:

1. A method of removing trash from material, comprising the steps of:

feeding the material to an inside of a drum having a screen on the periphery thereof;

rotating the drum;

cyclically lifting the material toward an upper portion of the drum with a plurality of finger-shaped baffles carried by the periphery and dropping the material directly onto the screen at a lower portion of the drum to break up clusters of material and separate the trash;

permitting relatively heavy trash to drop through the screen while retaining the remaining material; and continuously clearing material from openings in the screen.

2. The method accoridng to claim 1, wherein the step of continuously clearing material includes the step of rotating a brush having its outer periphery in contact with an outer peripheral surface of the screen along an axis parallel to the axis of the drum.

3. The method of claim 2, wherein the brush is rotated at a peripheral speed which is greater than the peripheral speed on the screen of the drum.

4. The method according to claim 1, further comprising the step of further breaking up clumps of material by impacting the clumps against rod-like elements extending inwardly of the periphery of the drum.

5. An apparatus for removing trash from material, comprising:

an elongated drum for receiving the material from which trash is to be removed;

means for rotating the drum;

screen means surrounding the periphery of the drum for allowing heavy trash to drop through;

a plurality of finger-shaped baffles for lifting the material toward an upper portion of the drum and dropping the material onto the screen means, said baffles being arranged to extend inwardly from the periphery of the first drum; and means for continuously clearing material from openings in said screen means.

6. The apparatus according to claim 5, wherein said means for continuously clearing material is arranged at a location on an outside of said drum which location is beyond the location where said baffles drop said material in the direction of rotation of said drum.

7. The apparatus according to claim 5, wherein the means for continuously clearing material comprises an elongated brush, said brush being arranged such that an outer peripheral surface of the brush contacts an outer surface of the screen means.

8. The apparatus according to claim 7, wherein a longitudinal axis of said brush is substantially parallel to a longitudinal axis of the drum.

9. The apparatus according to claim 7, further comprising driving means for rotating said brush about a longitudinal axis.

10. The apparatus according to claim 9, further comprising gear means for meshing engagement between said brush and said drum, said driving means rotating said drum through said gear means.

11. The apparatus according to claim 9, wherein the outer peripheral speed of said brush is greater than the outer peripheral speed of the drum.

12. The apparatus according to claim 9, wherein said brush has the same direction of rotation as said drum.

13. An apparatus for removing trash from material comprising:

an elongated drum for receiving the material;

means for rotating the drum;

screen means surrounding the periphery of the drum for allowing heavy trash to drop through; and a plurality of finger-shaped baffles for lifting the material toward an upper portion of the drum and dropping the material onto the screen means, said baffles being arranged to extend radially inwardly of the screen means of the drum, said baffles being the only structural elements extending inwardly of the screen means.

14. The apparatus according to claim 13, wherein the baffles comprise between two and four rows along a longitudinal axis of the drum, the baffles of each row being parallel to one another.

15. The apparatus according to claim 14, wherein the rows are arranged symmetrically about the inside circumference of the drum.

16. The apparatus according to claim 13, wherein the screen means comprises sheet metal having a plurality of holes of a predetermined size therein, said sheet metal being self-supporting.

17. The apparatus according to claim 13, wherein said lifting and dropping of said material simulates a vibratory action.

18. The apparatus according to claim 13, further comprising means for continuously clearing material from openings in said screen means.

* * * * *